US006186184B1

(12) United States Patent
Eberhard

(10) Patent No.: US 6,186,184 B1
(45) Date of Patent: Feb. 13, 2001

(54) HEALD LOOM AND A METHOD FOR REGULATING A HEALD LOOM

(75) Inventor: Ernst Eberhard, Dürnten (CH)

(73) Assignee: Sulzer Rueti AG, Rueti (CH)

( * ) Notice: Under 35 U.S.C. 154(b), the term of this patent shall be extended for 0 days.

(21) Appl. No.: 09/059,660

(22) Filed: Apr. 13, 1998

(30) Foreign Application Priority Data

Apr. 16, 1997 (EP) ..... 97810234
Apr. 22, 1997 (EP) ..... 97810245

(51) Int. Cl.[7] ..... D03C 1/16; D03D 51/02
(52) U.S. Cl. ..... 139/1 E; 318/432
(58) Field of Search ..... 139/1 E; 318/432, 318/611, 625

(56) References Cited

U.S. PATENT DOCUMENTS 5,306,993 * 4/1994 De Fries et al. ..... 318/561
5,642,757 * 7/1997 Fromment et al. ..... 139/1 E
5,646,495 * 7/1997 Toyozawa et al. ..... 318/625
5,755,267 * 5/1998 Eberhard et al. ..... 139/1 E

FOREIGN PATENT DOCUMENTS 9102560 7/1991 (DE) .
0736622A1 10/1996 (EP) .
0743383A1 11/1996 (EP) .

* cited by examiner

*Primary Examiner*—Andy Falik
(74) *Attorney, Agent, or Firm*—Townsend and Townsend and Crew LLP

(57) ABSTRACT

A heald loom comprises a weaving machine (1) and a dobby (2) which can be coupled to one another via a mechanical transmission apparatus (3) and have a common drive train in the coupled state which can be driven by a main drive (5) It further comprises an auxiliary drive (6) which is arranged to act at least on the part of the drive train driving the dobby. The heald loom further comprises at least one sensor (7, 8) which measures the torque actually present at the drive train and which is arranged along the drive train in the region between the weaving machine (1) and the dobby (2) or in the end region of the weaving machine (1) or the dobby (2) respectively bordering on this region. This sensor (7, 8) is connected to a control system (9) which actuates the auxiliary drive (6) in such a manner that the torque and/or fluctuations in the speed of rotation present between the weaving machine (1) and the dobby (2) are reduced.

7 Claims, 2 Drawing Sheets

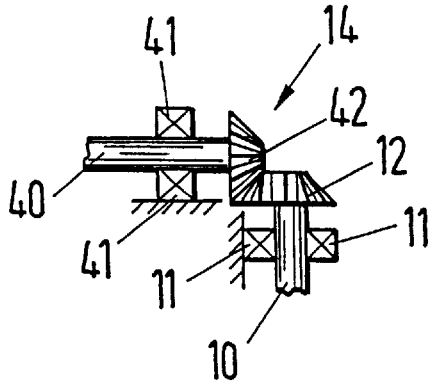
Fig. 4
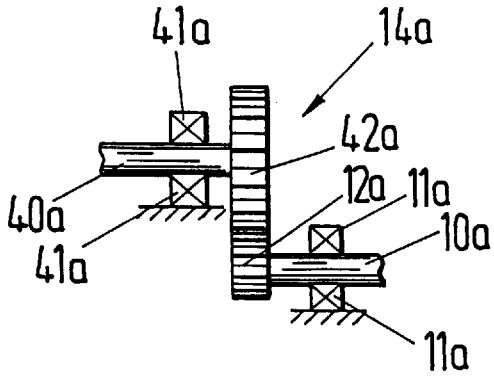
Fig. 5
Fig. 6
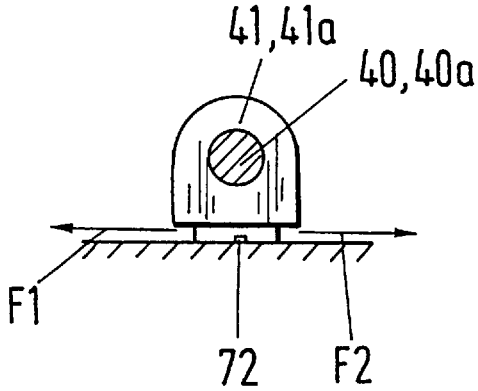

HEALD LOOM AND A METHOD FOR REGULATING A HEALD LOOM

BACKGROUND OF THE INVENTION

The invention relates to a heald loom and to a method for regulating a heald loom.

Known heald looms comprise a weaving machine for the insertion of a west thread and a dobby as an apparatus for the formation of the shed. The weaving machine and the dobby can usually be coupled to one another via a transmission apparatus, for example via a clutch and a gear box, and have a common drive train in the coupled state. This common drive train is usually driven by means of a drive—usually a motor—and in turn drives both the weaving machine and the dobby.

Heald looms of this kind have the disadvantage that a motor with a high power output is required (e.g. as a result of a large number of heavy heald frames or a large web width), in particular when driving a large dobby. Furthermore, the torque required both by the weaving machine and by the dobby in the free-running state varies in dependence on the angle of rotation (instantaneous rotary position). This is caused above all by various massive oscillating components of the individual machines. As the size of the dobby and the speed of rotation of the weaving machine increase, the load to which the entire drive train is subjected, in particular also part of the drive train arranged between the weaving machine and the dobby, increases considerably. In addition, the required torque also depends on other operating parameters, such as, e.g., the speed of rotation, the type of cloth or the weaving pattern to be produced.

The torques that arise when the machine starts up and torque fluctuations produced as a result of fluctuations in the speed of rotation can exceed the power capacity of the motor and/or the permissible load on the drive train, or at least considerably shorten its lifetime. It is then not only necessary to provide a high-power motor, the entire drive train must also be strengthened, requiring stronger shafts, transmissions, clutches, bearings, etc., which represents a considerable technical cost and effort and makes the machine significantly more expensive.

In the field of Jacquard weaving machines EP-A-0 736 622 discloses to provide an auxiliary motor for the Jacquard attachment which is independent of the drive of the weaving machine, and to couple the drive shaft of the weaving machine to the drive shaft of the Jacquard apparatus via a synchronization shaft. The drive shaft of the Jacquard attachment can be additionally driven by means of this auxiliary motor. The auxiliary motor thus serves—when appropriately actuated—for the relief of the drive of the weaving machine as well as for the relief of the entire drive train. At the same time the synchronization shaft provides for a more or less adequate synchronization of the weaving machine and the Jacquard apparatus. In order to determine now which torque must be supplied by the auxiliary motor for the relief of the drive of the weaving machine, or for the relief of the drive train, an angle sensor is provided which detects the current rotary position of the drive shaft of the Jacquard attachment and supplies it to a control system. The control system then determines, with knowledge of the desired weaving pattern and the torques required at the respective angle of rotation (the required torques must thus already be known to the control system for each angle of rotation prior to starting the machine), the torque to be supplied by the auxiliary motor in order to relieve the drive of the weaving machine as well as the entire drive train.

The Jacquard weaving machine described in EP-A-0 736 622 is theoretically capable of functioning, but the proposed procedure is not simple to apply for heald looms, especially for large heald looms with heavy heald frames. As a result of the torque fluctuations produced by large oscillating masses and by fluctuations in the speed of rotation and other operating parameters, the relationship between the actual torque present along the drive shaft and the respective peripheral position of the drive shaft of the dobby, in particular in large heald looms, is namely not constant and therefore also cannot be predicted, or at best can only be imprecisely predicted. An exact prediction of the torque arising along the drive train in dependence on the respective peripheral position is in any case not possible in practice. Therefore very large torques can still arise along the drive train, in particular in the part of the drive train arranged between the dobby and the weaving machine. Thus in order to ensure a high degree of reliability and/or availability of the machine, similarly elaborate measures with respect to the dimensioning of the drives and the drive train as described above must be taken.

Furthermore, a heald loom is disclosed by EP-A-0 743 383 which operates in accordance with a principle similar to that of the Jacquard weaving machine already explained above. In this machine a main motor is also provided for driving the weaving machine and is coupled via a mechanical transmission apparatus to a dobby (or, alternatively, to a Jacquard attachment). Furthermore, an auxiliary motor is provided at the dobby which relieves the main motor and/or the drive train. The type of control of the main motor presupposes that the torque required for the driving of the dobby at a definite speed of rotation is known to the control system prior to starting up the machine for every angle of rotation (rotary position), whether it be through a "theoretical" determination of the required torque performed prior to the start, or through values for the torque determined in trial runs. In practice, however, as a result of the torque fluctuations produced by the large oscillating masses, in particular in large dobbies with heavy heald frames, and as a result of the torque fluctuations produced by speed of rotation fluctuations and other operating parameters, the torque actually present along the drive train cannot be or at best can be only very imprecisely predicted in dependence on the rotary position. Large torques can still arise in the part of the drive train arranged between the weaving machine and the dobby in particular. Therefore, in order to ensure a high degree of reliability and availability of the machine, correspondingly elaborate measures with respect to the dimensioning of the drives and of the drive train must be taken as described above.

SUMMARY OF THE INVENTION

It is therefore an object of the invention to provide a heald loom in which this great cost and effort—namely providing a high power motor and reinforcing all parts of the drive train—can be avoided, in particular for large dobbies with heavy heald frames and a high speed of rotation. At the same time, an economical and reliable operation of a heald loom of this kind is to be ensured.

In the heald loom in accordance with the invention, at least one sensor is arranged in the region between the weaving machine and the dobby, or at the end region of the weaving machine or the dobby respectively bordering on this region. The sensor which is arranged there (a plurality of sensors can also be provided for this purpose) measures the torque which is actually present at the drive train. The greatest changes which are produced by the torque (e.g. the greatest torsion of the drive shaft) usually arise in the named region, because the torque fluctuations are substantially produced by the large oscillating masses in the dobby and the weaving machine. Thus, the variations produced thereby are particularly easy to measure in the named region. The sensor is connected to a control system which actuates the auxiliary drive (e.g. an auxiliary motor) in such a manner that the torque and/or fluctuations in the speed of rotation present in the region between the weaving machine and the dobby are reduced. In this way, a relief of the main drive and of the entire drive train is provided so that it is possible to employ standard motors as a main drive as well as standard drive shafts, clutches and bearings, even for heavy dobbies, which considerably reduces the complication and expense. A reinforcement of individual parts or of all parts of the drive train and the replacement of the standard drive motor by a more powerful one is thereby eliminated.

In an advantageous exemplary embodiment of a heald loom made in accordance with the invention, the sensor or parts thereof (e.g. a strain gauge arrangement) is arranged on the drive train. In this way the represenatative value for the torque present at the respective time point can be derived directly at the drive train and is thus not falsified. In addition it is also not necessary to determine the torque via any complicated devious routes.

The sensor preferably produces an electrical signal as a function of the torque actually present, that is, for example, a sensor which comprises a strain gauge arrangement, with the strain gauge arrangement being arranged directly on the drive train. The sensor must also have a suitable transmission element (a transmitter) for the transmission of the signal from the drive train, which is in rotation during operation, to a part of the machine which is fixed during operation. A strain gauge arrangement which is arranged on the drive train is therefore particularly suitable for measuring the torque because its output signal is directly proportional to the torque (alternatively, sensors for the measurement of shear stresses are also suitable). The torque present can thus be obtained rapidly and without distortion from the signal of the sensor.

Likewise, sensors can be considered which are constructed as angle transducers and which are arranged with a displacement with respect to one another when viewed in the longitudinal direction of the drive train. The angle transducers detect the rotary position of the respective part of the drive train. Since each part of the drive train is to a certain extent elastic (up to a certain extent), it is possible—if a torque is present and if the resolution of the transducers is sufficiently good—to measure an angular difference between two different positions of the drive train. This angular difference is a measure for the torque present since the angular difference is produced by the torque. Thus the signal of an individual sensor is not representative for the torque in this case, but the angular difference, however, is. In addition, the respective current speed of rotation can be monitored with this kind and arrangement of sensors.

Furthermore, a sensor can also be considered which is constructed as a force pick-up sensor and is arranged in such a manner that it measures reaction forces which are produced on a part of the heald loom which is fixed during operation such as, e.g., at a bearing or at a gearbox. The sensor signal is then a direct measure for the torque present.

A further advantageous exemplary embodiment of a heald loom made in accordance with the intention has, in addition to the main drive and to the auxiliary drive, a further drive which can be coupled to the part of the drive train driving the dobby. This additional drive, which typically comprises a motor and crawling speed drive, is used in weaving machines, for example in the weft search, in order to open the shed independently of the main drive. The auxiliary drive provided in accordance with the invention is now in a position to considerably relieve this additional drive (crawling speed drive). If the auxiliary drive is precisely controllable, then it is possible in principle that the auxiliary drive also takes over the function of the (crawling speed) drive, and thereby the additional (crawling speed) drive named here is not required. At least, however, the additional (crawling speed) drive can be considerably relieved by the auxiliary drive provided in accordance with the invention.

In the method in accordance with the invention the torque present at the drive train is measured by means of at least one sensor which is arranged between the weaving machine and the dobby, or in the end regions of the machine bordering on this region, and a corresponding signal is transmitted to a control system. As a result of this signal the auxiliary drive is actuated by the control system in such a manner that the torque and/or fluctuations in the speed of rotation present in the region between the weaving machine and the dobby are reduced. The complication and expense of a strengthening of the main drive and the parts of the drive train, in particular of shafts, bearings, transmissions and clutches, which were already mentioned above are thereby avoided.

BRIEF DESCRIPTION OF THE DRAWINGS

FIG. 4 shows another embodiment of the invention employing bearings subjected to forces generated by torque, FIG. 5 shows a further embodiment illustrating bearings subjected to forces generated by torque, and FIG. 6 is an enlarged illustration of a bearing subjected to forces generated by torque and a force pick-up sensor.

DETAILED DESCRIPTION OF THE PREFERRED EMBODIMENTS

Figure 1:
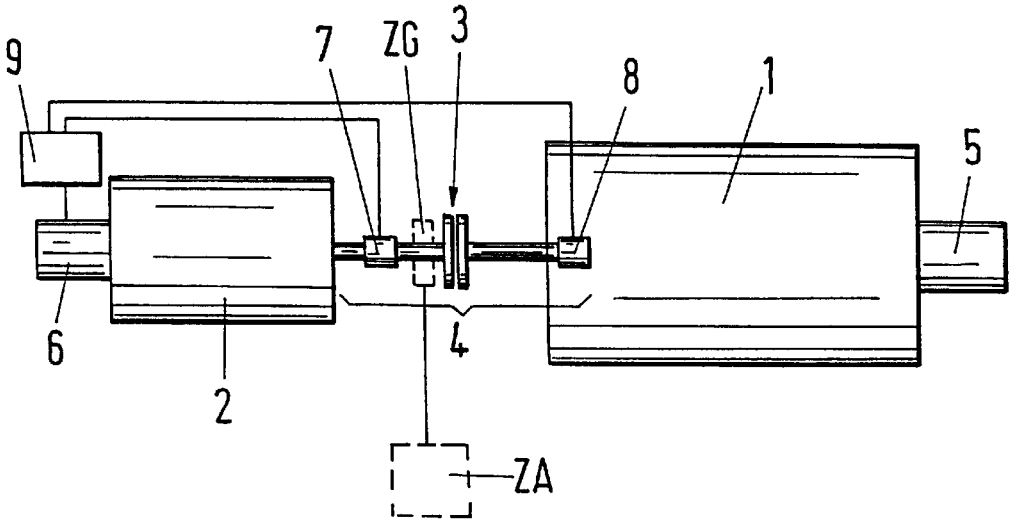
FIG. 1 shows a first embodiment of a heald loom made in accordance with the invention.

The exemplary embodiment of the heald loom in accordance with the invention shown in FIG. 1 comprises a weaving machine 1 and a dobby 2. The weaving machine 1 and the dobby 2 can be coupled to one another by means of a mechanical transmission apparatus which comprises a clutch 3 so that they have a common drive train in the coupled state, of which only the part 4 between the weaving machine 1 and the dobby 2 is illustrated for reasons of draftsmanship. Furthermore, the heald loom comprises a main drive arranged at the weaving machine 1 in the form of a motor 5 (usually an electric motor) and an auxiliary drive in the form of a motor 6 (likewise usually an electric motor) arranged at the dobby 2. Moreover, the exemplary embodiment of the heald loom shown also comprises sensors 7 and 8, each of which is connected to a control system 9 by means of signal lines. The control system 9 in turn is connected by means of a signal line to the motor 6, that is, to the auxiliary drive. Finally, a further (additional) drive ZA (crawling speed) is provided optionally in FIG. 1, can be coupled to the drive train via a corresponding transmission ZG, and can come into use in the weft search, either alone (in this case, however, it must be dimensioned in such a manner that it is capable of driving the dobby alone in the crawling speed mode), or else together with the motor 6.

During operation the motor 5 drives the weaving machine 1 and, as a result of the coupling of the weaving machine 1 and the dobby 2, also the dobby 2. During this a very large torque can be present, especially at the illustrated part 4 of the drive train, as a result of the large oscillating weighty components in the weaving machine 1 and the dobby 2, which adds to the drive torque required for moving the heald frames. This torque, which is actually present at the drive train in this region, is measured either by means of only one of the two sensors 7 and 8 or by means of both sensors. Whether the torque is measured by means of only one of the sensors 7, 8 or by means of both sensors 7 and 8 depends on how many sensors are actually provided and depends above all on which type of sensor is used. The different types of sensors will be discussed more precisely below. The output signal of the sensors 7 and 8 is supplied by means of signal lines to a control system 9, which in turn actuates the motor 6, that is, the auxiliary drive, via a signal line 10. The actuation of the motor 6 by the control system 9 proceeds in such a manner that the torque and/or fluctuations in the speed of rotation present between the weaving machine 1 and the dobby 2 are reduced. Thus in the reduction of the torque present between the weaving machine 1 and the dobby 2 both the ("static") torque required for the driving and the ("dynamic") torque fluctuations arising as a result of the oscillating massive components can be reduced in this manner.

In regard to the regulation of the torque, different control strategies are suitable, such as:

a) Limitation of the positive or negative torque to a maximum permissible value b) Reduction of the torque by a constant factor or in accordance with a predetermined mathematical law c) Limitation or reduction of the torque variation as a function of time d) Both a limitation of the maximum torque present and at the same time a reduction of the torque e) Limitation of the torque to a minimum value tending to zero.

To further explain, consider the case in which the weaving machine 1 and the dobby 2 attempt a contrary movement, which means that the one machine requires an increasing torque with respect to the increasing angle of rotation, while the other machine requires a decreasing torque with respect to the increasing angle of rotation (the one machine acting as if braking, the other, in contrast, as if driving). This produces a large torque in the clutch 3 and in the part 4 of the drive train arranged between the weaving machine 1 and the dobby 2. This large torque is measured by the sensors 7 and 8 (or else by only one of the two, depending on the sensor type) and transmitted to the control system 9 in the form of an electric signal. The control system 9 then actuates the auxiliary drive, that is, the motor 6, in such a manner that this torque is reduced. The drive train and also the main drive, that is, the motor 5, which would otherwise have to produce this torque alone are thereby relieved.

The solution in accordance with the invention is however advantageous with respect to the total energy consumption (that is, the total power which is needed for the production of the required torque). This is causally related to the mechanical coupling. In a heald loom with mechanically separate drives for the dobby and the weaving machine, that is, without connection elements, the energy for the like running of the two machines would have to be completely supplied by the drives of the machines (thus in the event of contrary movement tendencies, one drive motor must act in a braking manner and the other in a driving manner), which would be associated with corresponding conversion losses (in the motors). In the case of a mechanical coupling, on the other hand, the different movement tendencies compensate each other at least partially via the mechanical coupling of the weaving machine and the dobby (which expresses itself, e.g., in a torsion). A heald loom with a mechanical coupling between the weaving machine and the dobby is in this case more advantageous than a heald loom without a mechanical coupling.

With regard to the regulation of the speed of rotation, different control strategies are available, such as:

a) Limitation of the speed of rotation to a maximum permissible value b) Limitation of the peak values of the change in the speed of rotation c) Reduction of the fluctuations in the speed of rotation to a value tending to zero.

Consider in an exemplary manner the case in which the weaving machine 1 and the dobby 2 both attempt a movement in the same direction, with both machines requiring a decreasing torque with respect to the increasing angle of rotation (which means that they tend toward a higher speed of rotation). A corresponding signal is transmitted from the sensors 7 and 8 to the control system 9. The control system 9 then actuates the motor 6 such that it acts in a braking manner on the drive train, since otherwise the speed of rotation would increase (and the main drive alone would have to act in a braking manner on the drive train).

Furthermore, consider in an exemplary manner the case in which the weaving machine 1 and the dobby 2 also attempt a movement in the same direction, however in such a manner that both machines require an increasing torque with respect to the increasing angle of rotation (which means that they tend toward a lower speed of rotation). A corresponding signal is transmitted from the sensors 7 and 8 to the control system 9. The control system 9 then actuates the motor 6 such that it acts in a driving manner on the drive train, since otherwise the speed of rotation would decrease or else the main drive would have to supply the entire drive power alone. This would however mean a higher load on the main drive, which would have to supply the entire required acceleration torque alone.

Mixed control strategies are conceivable, that is, strategies in which fluctuations in the torque and/or fluctuations in the speed of rotation are regulated casewise. For example, one strategy can be that a) the speed of rotation is regulated when the torque varies in the same sense with respect to the increasing angle of rotation, and thus, as a rule, a small torque is present between the weaving machine 1 and the dobby 2 and b) the torque is regulated in a manner such that the part 4 of the drive train arranged between the weaving machine 1 and the dobby 2 and the clutch 3 is relieved when the torque varies with respect to the increasing angle of rotation in contrary senses, and thus, as a rule, a large torque is present between the weaving machine 1 and the dobby 2. A strategy of this kind is also favorable in regard to the total efficiency.

Figure 2:
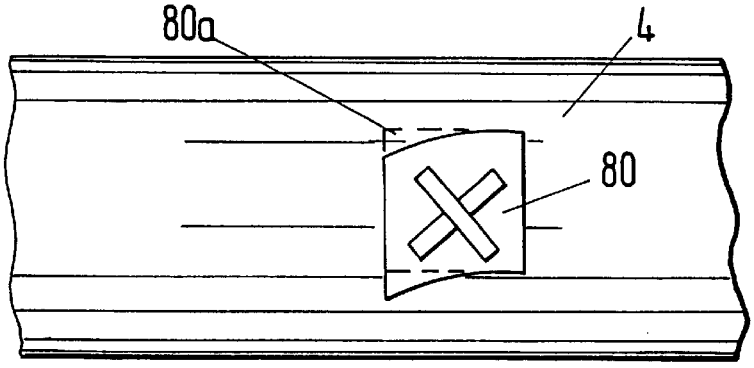
FIG. 2 is a section of the drive train on which a strain gauge arrangement is fastened.

For the measurement of the torque which is present at the drive train between the weaving machine 1 and the dobby 2 a sensor can be mounted on the part 4 of the drive train, with the sensor comprising a strain gauge arrangement. A sensor of this kind is schematically shown (greatly enlarged) in FIG. 2. There one recognizes a strain gauge arrangement 80, which is deflected from its rest position 80*a* as a result of a torsion of the part 4 of the drive train which is produced by the torque present. The rest position 80*a* is shown in broken lines in FIG. 2. The output signal of the strain gauge arrangement 80 is a measure of the torsion in the part 4 of the drive train and the torsion of the part 4 of the drive train is in turn a measure of the torque present. Thus if the torque present is the only variable to be regulated, a single sensor 80 of this kind is sufficient. It is self-evident that a sensor 80 of this kind has a suitable transmitter element (e.g. a suitable transducer, not shown in FIG. 2 for reasons of draftsmanship) which transmits the output signal of the strain gauge arrangement from the rotating drive train to a fixed part of the machine during operation.

Figure 3:
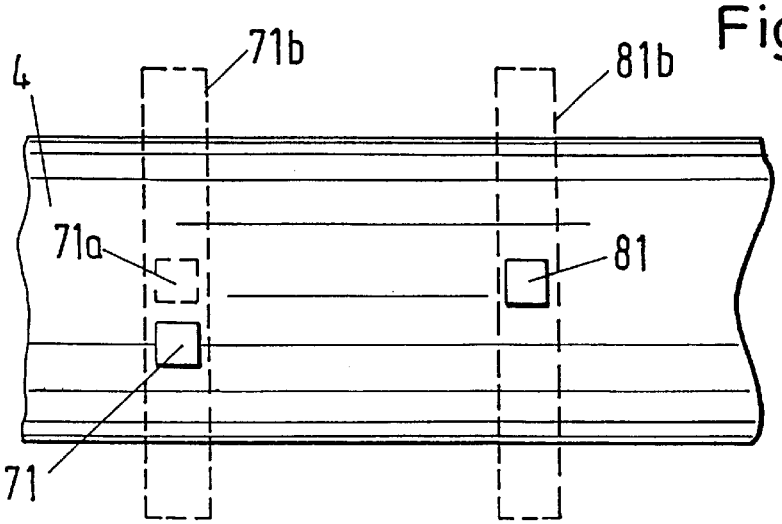
FIG. 3 is a section of the drive train with two angle sensors arranged displaced in the longitudinal direction of the drive train.

Another exemplary embodiment, shown in FIG. 3, has two sensors which are executed as angle sensors 71 and 81 and are arranged with a displacement with respect to one another when viewed in the longitudinal direction of the drive train. Since the part 4 of the drive train is twisted as a result of a torque which is present here, the angle sensor 71 is deflected from its rest position 71*a,* which is indicated in broken lines. In order to determine the deflection, one needs corresponding detectors which are arranged along the periphery of the drive train. This is schematically indicated by the dashed lines 71*b* and 81*b* in FIG. 3. The measure of the displacement with respect to the rest position is a measure for the torsion of the part 4 of the drive train, and this in turn is a measure of the torque present. Angle sensors however also have the advantage that not only the torque present but also the respective current speed of rotation can be determined with their help.

In FIG. 4, FIG. 5 and FIG. 6, finally, those exemplary embodiments are illustrated in which the torque present is measured by means of force pick-up sensors which measure the forces at parts which are fixed during operation, e.g. at bearings. An angle transmission 14 such as can be provided, e.g., between the weaving machine 1 and the part 4 (FIG. 1) of the drive train is provided in FIG. 4. The two parts of the drive train are illustrated here only sectionally; one recognizes an end piece 10 of the part of the drive train coming from the weaving machine 1 and an end piece 40 of the part 4 of the drive train provided between the weaving machine 1 and the dobby 2. The two end pieces facing one another are guided in bearings 11 and 41 respectively and are mechanically coupled to one another by means of the bevel gears 12 and 42. If a force or torque is transferred from the bevel gear 12 to the bevel gear 42, then the part 4 of the drive train would want to deflect, but is prevented from doing so by the bearing 41. As a result, a corresponding force acts on the bearing 41 and is measured by a corresponding force pick-up sensor (see FIG. 6).

Another transmission 14*a* such as can be provided between the weaving machine 1 and the part 4 of the drive train is illustrated in FIG. 5. The two parts of the drive train are illustrated only sectionally here; one recognizes an end piece 10*a* of the part of the drive train coming from the weaving machine 1 and an end piece 40*a* of the part 4 of the drive train provided between weaving machine 1 and the dobby 2. The two end pieces are again guided in bearings 11*a* and 41*a* respectively and mechanically coupled to one another by means of gears 12*a* and 42*a* which mutually engage radially. If a force or a torque is transmitted from the gear 12*a* to the gear 42*a,* then the part 4 of the drive train would want to deflect, but is prevented from doing so by the bearing 41*a*. As a result, a corresponding force acts on the bearing 41*a* which is measured by a corresponding force pick-up sensor (see FIG. 6) in a manner similar to that in the exemplary embodiment described in reference to FIG. 4.

Finally, FIG. 6 schematically shows a sensor 72 which, for example, can be provided at the bearing 11 or 11*a* respectively (FIG. 4, FIG. 5). As has already been explained with reference to FIG. 4 and FIG. 5, a force acts on the bearing 41 or 41*a* when a force or torque is being transferred to the part 4 of the drive train, since the drive train is guided in the bearing and cannot escape. In this arrangement, the forces acting on the bearing 41*a* in the direction of the arrows F1 and F2 can be measured by the sensor 72, and the force or torque which has caused the corresponding force on the bearing can be determined in this manner.

The heald loom comprises a weaving machine and a dobby which can be coupled to one another via a mechanical transmission apparatus and have a common drive train in the coupled state which can be driven by a main drive. It further comprises an auxiliary drive which is arranged to act at least on the part of the drive train driving the dobby. The heald loom further comprises at least one sensor which measures the torque actually present at the drive train and which is arranged along the drive train in the region between the weaving machine and the dobby or in the end region of the weaving machine or the dobby respectively bordering on this region. This sensor is connected to a control system which actuates the auxiliary drive in such a manner that the torque and/or fluctuations in the speed of rotation present between the weaving machine and the dobby are reduced.

What is claimed is:

1. Heald loom system comprising a weaving machine and a dobby coupled to one another by a mechanical transmission apparatus driven by a main drive to effect a common drive train in the coupled state which is subjected to torque and/or fluctuations in a speed of rotation present between the weaving machine and the dobby, the loom system further comprising an auxiliary drive which is arranged to act at least on a part of the drive train driving the dobby, and at least one sensor which measures the torque encountered at the drive train and arranged along the drive train in a region between the weaving machine and the dobby or in an end region of the weaving machine or the dobby respectively, bordering on the region; the sensor being connected to a control system for actuating the auxiliary drive in such a manner that the torque and/or fluctuations in the speed of rotation present between the weaving machine and the dobby are reduced.

2. Heald loom system in accordance with claim 1 wherein at least a part of the sensor is arranged on the drive train.

3. Heald loom system in accordance with claim 2 wherein the sensor comprises a strain gauge arrangement and a transmission element for the transmission of a signal from the drive train to the control system.

4. Heald loom system in accordance with claim 1 wherein at least two sensors are associated with the drive train and comprise angle sensors that are arranged to be mutually displaced when viewed in a longitudinal direction of the drive train.

5. Heald loom system in accordance with claim 1 wherein the heald loom system includes a stationary part subjected to a force generated by the torque encountered at the drive train, and wherein the sensor comprises a force pick-up sensor arranged in such a manner that it measures the force to which the stationary part is subjected.

6. Heald loom system in accordance with claim 1 comprising, in addition to the main drive and the auxiliary drive, a further drive which can be coupled to the part of the drive train driving the dobby.

7. A method for controlling a torque and/or fluctuations in a speed of rotation between a weaving machine and a dobby of a heald loom, the weaving machine and the dobby being coupled to each other by a mechanical transmission apparatus driven by a main drive to effect a common drive train in their coupled state, the heald loom including an auxiliary drive acting at least on a part of the drive train driving the dobby, the method comprising the steps of monitoring the torque encountered at the drive train; generating a signal which is responsive to the monitored torque encountered at the drive train; and controlling the operation of the auxiliary drive with the signal so that the torque and/or fluctuations in the speed of rotation between the weaving machine and the dobby are reduced.

* * * * *